US011027564B2

(12) United States Patent
Imamura et al.

(10) Patent No.: US 11,027,564 B2
(45) Date of Patent: Jun. 8, 2021

(54) PRINTING APPARATUS AND PRINTING METHOD

(71) Applicant: SEIKO EPSON CORPORATION, Tokyo (JP)

(72) Inventors: Atsushi Imamura, Shiojiri (JP); Jun Yamada, Matsumoto (JP); Masashi Kitahara, Minamiminowa-Mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/810,244

(22) Filed: Mar. 5, 2020

(65) Prior Publication Data

US 2020/0282749 A1 Sep. 10, 2020

(30) Foreign Application Priority Data

Mar. 8, 2019 (JP) ..... JP2019-042322

(51) Int. Cl.

| | |
|---|---|
| ***B41J 11/04*** | (2006.01) |
| ***B41J 11/44*** | (2006.01) |
| ***B41J 15/16*** | (2006.01) |
| ***B41J 15/04*** | (2006.01) |
| ***B41J 29/38*** | (2006.01) |
| ***B41J 11/00*** | (2006.01) |
| ***B41J 2/21*** | (2006.01) |
| ***B65H 23/192*** | (2006.01) |

(52) U.S. Cl.

CPC ..... *B41J 11/44* (2013.01); *B41J 2/2114* (2013.01); *B41J 2/2132* (2013.01); *B41J 11/0015* (2013.01); *B41J 11/04* (2013.01); *B41J 15/044* (2013.01); *B41J 15/046* (2013.01); *B41J 15/165* (2013.01); *B41J 29/38* (2013.01); *B65H 23/192* (2013.01)

(58) Field of Classification Search

CPC ..... B41J 2/2114; B41J 2/2132; B41J 11/04; B41J 15/165; B41J 15/046; B41J 29/38; B41J 15/044

See application file for complete search history.

(56) References Cited

U.S. PATENT DOCUMENTS

2013/0278666 A1* 10/2013 Hori ..... B41J 15/165 347/16
2016/0001457 A1* 1/2016 Shapiro ..... B26D 7/015 83/487
2020/0062011 A1* 2/2020 Terradellas Callau ..... B41J 13/0009

FOREIGN PATENT DOCUMENTS

JP 2017-170817 9/2017

* cited by examiner

*Primary Examiner* — Lamson D Nguyen
(74) *Attorney, Agent, or Firm* — Workman Nydegger

(57) ABSTRACT

In a printing apparatus, a controller is configured to control a printing unit such that printing is started after a transport distance of the substrate reaches a pre-discharge transport distance, in which the pre-discharge transport distance is set to a value not less than a first longest distance, provided that a transport distance in a condition in which the transport distance is a longest distance among conditions 1, 2, and 3 provided below is the first longest distance. Condition 1: a transport distance until a region of the substrate that was nipped between a front driving roller and a nip roller passes through a printing head disposed most downstream in a transport path of the substrate, Condition 2: a transport distance until a transport speed of the substrate becomes constant, and Condition 3: a transport distance until tension of the substrate being transported becomes stable.

6 Claims, 4 Drawing Sheets

| COMBINATION | CORONA TREATMENT | ACCELERATION RATE [mm/sec²] | TRANSPORT SPEED [m/min] | CONDITION (1) [m] | CONDITION (2) [m] | CONDITION (3) [m] | CONDITION (4) [m] | PRE-DISCHARGE TRANSPORT DISTANCE [m] |
|---|---|---|---|---|---|---|---|---|
| A | NO (FIRST MODE) | NORMAL TRANSPORT (110.5) | 7.6 | 1.85 | 0.09 | 0.99 | - | 2.0 |
| B | | | 15 | 1.85 | 0.36 | 1.80 | - | 2.0 |
| C | | | 30 | 1.85 | 1.43 | 3.84 | - | 4.0 |
| D | | | 50 | 1.85 | 3.95 | 5.77 | - | 6.0 |
| E | | LOW TENSION TRANSPORT (44.2) | 7.6 | 1.85 | 0.22 | 0.92 | - | 2.0 |
| F | | | 15 | 1.85 | 0.89 | 1.55 | - | 2.0 |
| G | | | 30 | 1.85 | 3.57 | 3.21 | - | 4.0 |
| H | | | 50 | 1.85 | 9.87 | 4.48 | - | 10.0 |
| I | YES (SECOND MODE) | NORMAL TRANSPORT (110.5) | 7.6 | 1.85 | - | 0.99 | 2.90 | 3.0 |
| J | | | 15 | 1.85 | - | 1.80 | 3.16 | 3.5 |
| K | | | 30 | 1.85 | - | 3.84 | 4.23 | 4.5 |
| L | | | 50 | 1.85 | - | 5.77 | 6.76 | 7.0 |
| M | | LOW TENSION TRANSPORT (44.2) | 7.6 | 1.85 | - | 0.92 | 3.03 | 3.5 |
| N | | | 15 | 1.85 | - | 1.55 | 3.70 | 4.0 |
| O | | | 30 | 1.85 | - | 3.21 | 6.38 | 6.5 |
| P | | | 50 | 1.85 | - | 4.48 | 12.68 | 13.0 |

| COMBINATION | CORONA TREATMENT | ACCELERATION RATE [mm/sec$^2$] | TRANSPORT SPEED [m/min] | CONDITION (1) [m] | CONDITION (2) [m] | CONDITION (3) [m] | CONDITION (4) [m] | PRE-DISCHARGE TRANSPORT DISTANCE [m] |
|---|---|---|---|---|---|---|---|---|
| A | NO (FIRST MODE) | NORMAL TRANSPORT (110.5) | 7.6 | 1.85 | 0.09 | 0.99 | - | 2.0 |
| B | | | 15 | 1.85 | 0.36 | 1.80 | - | 2.0 |
| C | | | 30 | 1.85 | 1.43 | 3.84 | - | 4.0 |
| D | | | 50 | 1.85 | 3.95 | 5.77 | - | 6.0 |
| E | | LOW TENSION TRANSPORT (44.2) | 7.6 | 1.85 | 0.22 | 0.92 | - | 2.0 |
| F | | | 15 | 1.85 | 0.89 | 1.55 | - | 2.0 |
| G | | | 30 | 1.85 | 3.57 | 3.21 | - | 4.0 |
| H | | | 50 | 1.85 | 9.87 | 4.48 | - | 10.0 |
| I | YES (SECOND MODE) | NORMAL TRANSPORT (110.5) | 7.6 | 1.85 | - | 0.99 | 2.90 | 3.0 |
| J | | | 15 | 1.85 | - | 1.80 | 3.16 | 3.5 |
| K | | | 30 | 1.85 | - | 3.84 | 4.23 | 4.5 |
| L | | | 50 | 1.85 | - | 5.77 | 6.76 | 7.0 |
| M | | LOW TENSION TRANSPORT (44.2) | 7.6 | 1.85 | - | 0.92 | 3.03 | 3.5 |
| N | | | 15 | 1.85 | - | 1.55 | 3.70 | 4.0 |
| O | | | 30 | 1.85 | - | 3.21 | 6.38 | 6.5 |
| P | | | 50 | 1.85 | - | 4.48 | 12.68 | 13.0 |

FIG. 5

PRINTING APPARATUS AND PRINTING METHOD

The present application is based on, and claims priority from JP Application Serial Number 2019-042322, filed Mar. 8, 2019, the disclosure of which is hereby incorporated by reference herein in its entirety.

BACKGROUND

1. Technical Field

The present disclosure relates to a printing apparatus and a printing method.

2. Related Art

In the related art, when printing is performed in a roll-to-roll type printing apparatus, a printing is started after the transport of paper is started and the printing speed becomes constant (refer to JP 2017-170817 A).

Unfortunately, when the printing is started in a state where merely the paper is transported at constant speed, there is a concern in that performing printing onto the region where the paper was nipped may lower an image quality. There is also a concern in that performing printing while the tension is unstable may lower an image quality. When modifying the surface of paper in quality, there is also a concern in that performing printing onto the region where the treatment of modification is unstable may lower an image quality. Thus, there has been an issue in properly setting, when printing is performed, a pre-discharge transport distance, which is the amount by which the paper is transported before ink is discharged.

SUMMARY

A printing apparatus of the present disclosure is a printing apparatus that is configured to transport a substrate in a roll-to-roll scheme, the printing apparatus including a controller, a printing unit including a printing head, and a front driving roller and a nip roller disposed upstream of the printing unit and configured to nip and transport the substrate, in which is configured to control the printing unit such that a transport of the substrate is started from a state where the transport of the substrate is stopped and printing is started after a transport distance of the substrate reaches a pre-discharge transport distance, in which the pre-discharge transport distance is set to a value not less than a first longest distance, provided that a transport distance in a condition in which the transport distance is a longest distance among conditions 1, 2, and 3 provided below is the first longest distance.

Condition 1: a transport distance until a region of the substrate that was nipped between the front driving roller and the nip roller passes through the printing head disposed most downstream in a transport path of the substrate.

Condition 2: a transport distance until a transport speed of the substrate becomes constant.

Condition 3: a transport distance until tension of the substrate being transported becomes stable.

The printing apparatus described above may include a pre-treatment unit, disposed upstream of the printing unit in a transport path of the substrate, configured to perform pre-treatment on the substrate, the printing apparatus having a first mode for performing printing on the substrate by the printing unit without performing the pre-treatment on the substrate by the pre-treatment unit, and a second mode for performing printing on the substrate by the printing unit after performing the pre-treatment on the substrate using the pre-treatment unit, in which when the first mode is selected, the pre-discharge transport distance may be set to a value not less than the first longest distance, while when the second mode is selected, the pre-discharge transport distance may be set to a value not less than the second longest distance, provided that a transport distance in a condition in which the transport distance is a longest distance among the conditions 1 and 3 provided above and the condition 4 provided below is a second longest distance.

Condition 4: a transport distance until the transport speed becomes constant from a start of transport of the substrate, plus a transport distance until a leading end portion of a region pre-treated with the pre-treatment unit passes through the printing head disposed most downstream after the transport speed becomes constant.

The printing apparatus described above may involve a table in which whether the pre-treatment is performed, an acceleration rate until a transport speed of the substrate becomes constant, and a printing speed set as the transport speed of the substrate, as printing conditions when printing is performed, are associated with the pre-discharge transport distance according to the printing conditions, in which the controller may be configured, when performing printing, to collate the printing conditions with the table to set the pre-discharge transport distance.

A printing method according to the present disclosure is a printing method of a printing apparatus, the printing apparatus including a controller, a printing unit including a printing head, and a front driving roller and a nip roller disposed upstream of the printing unit and configured to nip and transport the substrate, and the printing apparatus being configured to transport the substrate in a roll-to-roll scheme, in which the controller controls the printing unit such that a transport of the substrate is started from a state where the transport of the substrate is stopped, and printing is started after a transport distance of the substrate reaches a pre-discharge transport distance, and in which the printing method includes setting a first pre-discharge transport distance in which the controller sets the pre-discharge transport distance to a value not less than the first longest distance, provided that a transport distance in a condition in which the transport distance is a longest distance among conditions 1, 2, and 3 provided below is a first longest distance.

Condition 1: a transport distance until a region of the substrate that was nipped between the front driving roller and the nip roller passes through the printing head disposed most downstream in a transport path of the substrate.

Condition 2: a transport distance until a transport speed of the substrate becomes constant.

Condition 3: a transport distance until tension of the substrate being transported becomes stable.

The printing method described above may involve a pre-treatment unit, disposed upstream of the printing unit in the transport path of the substrate, configured to perform pre-treatment on the substrate, the printing method having a first mode for performing printing on the substrate by the printing unit without performing the pre-treatment on the substrate by the pre-treatment unit, and a second mode for performing printing on the substrate by the printing unit after performing the pre-treatment on the substrate using the pre-treatment unit, in which the printing method may involve setting a first pre-discharge transport distance in which, when the first mode is selected, the controller sets the pre-discharge transport distance to a value not less than the first longest distance, and setting a second pre-discharge transport distance in which, when the second mode is selected, the controller sets the pre-discharge transport distance to a value not less than a second longest distance, provided that a transport distance in a condition in which the transport distance is a longest distance among the conditions 1 and 3 provided above and the condition 4 provided below is the second longest distance.

Condition 4: a transport distance until the transport speed becomes constant from a start of transport of the substrate, plus a transport distance until a leading end portion of a region pre-treated with the pre-treatment unit passes through the printing head disposed most downstream after the transport speed becomes constant.

The printing method described above may involve a table in which whether the pre-treatment is performed, an acceleration rate until a transport speed of the substrate becomes constant, and a printing speed set as the transport speed of the substrate, as printing conditions when printing is performed, are associated with the pre-discharge transport distance according to the printing conditions, in which the printing method, when printing is performed, may involve setting a first pre-discharge transport distance and setting a second pre-discharge transport distance, in which the printing conditions are collated with the table, to set the pre-discharge transport distance.

BRIEF DESCRIPTION OF THE DRAWINGS

FIG. 5 is a diagram illustrating results of a transport distance for conditions when an experiment when printing conditions are combined is performed.

DESCRIPTION OF EXEMPLARY EMBODIMENTS

A printing apparatus according to an embodiment of the present disclosure will be schematically described below with reference to the accompanying drawings. In the embodiment, the printing apparatus is a printing apparatus configured to transport a substrate in a roll-to-roll scheme. Hereinafter, an inkjet printer 1 of a line-type (hereinafter, merely referred to as printer 1) as an example of the printing apparatus will be described below.

An apparatus configuration of the printer 1 according to the embodiment will be described below.

Figure 1:
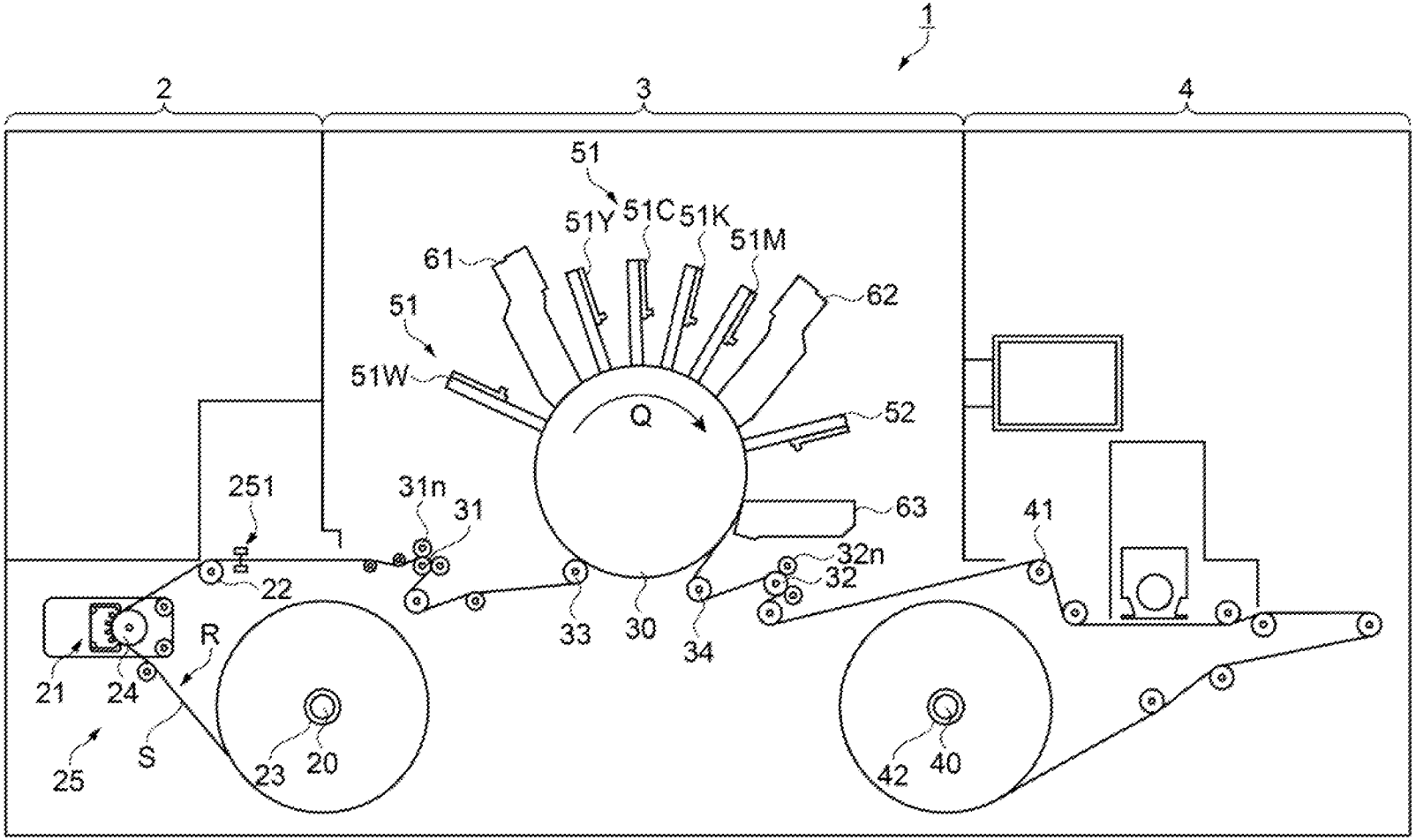
FIG. 1 is a front view schematically illustrating an example of an apparatus configuration of a printer to which the present disclosure is applied.

FIG. 1 is a front view schematically illustrating a configuration of the printer 1 to which the present disclosure is applied.

As illustrated in FIG. 1, in the printer 1, one piece of a substrate S is stretched along a transport path R, where both ends of the substrate S are wound around a feeding-out shaft 20 and a winding shaft 40 in a roll shape. The substrate S is subjected to printing while being transported in a transport direction Q directed from the feeding-out shaft 20 to the winding shaft 40. Note that the transport path R on which the substrate S is transported is formed by the substrate S passing sequentially through rollers that will be described below.

Types of the substrate S are broadly classified into a paper-based type and a film-based type. Specific examples of the paper-based type include a high-quality paper, cast paper, art paper, coated paper and the like, and specific examples of the film-based type include synthetic paper, polyethylene terephthalate (PET), polypropylene (PP) and the like.

The printer 1 includes, as a schematic configuration, a feeding-out section 2 (feeding region) for feeding the substrate S from the feeding-out shaft 20, a process section 3 (process region) for performing printing an image onto the substrate S fed-out from the feeding-out section 2, and a winding section 4 (winding region) for winding the substrate S on which the image has been printed by the process section 3, around the winding shaft 40. Note that in the description below, between both surfaces of the substrate S, the surface on which the image is printed is referred to as front surface and the reverse side surface of the front surface is referred to as back surface.

The feeding-out section 2 includes the feeding-out shaft 20 around which an end of the substrate S is wound, a corona treatment apparatus 21 being a pre-treatment unit configured to perform treatment to modify the surface of the substrate S drawn out from the feeding-out shaft 20, and a tension roller 22 (driven roller). Note that the corona treatment apparatus 21 being the pre-treatment unit is disposed upstream of a printing unit (printing heads 51 and 52) that will be described below in the transport path R of the substrate S.

The feeding-out shaft 20 supports the substrate S by winding the end of the substrate S around the feeding-out shaft 20 with the front surface of the substrate S facing outward. The feeding-out shaft 20 is then rotated clockwise in FIG. 1, the substrate S wound around the feeding-out shaft 20 is fed-out, via the pre-treatment unit (the corona treatment apparatus 21) and the tension roller 22, to the process section 3.

The substrate S is wound around the feeding-out shaft 20 via a core pipe being attachable to/detachable from the feeding-out shaft 20. Accordingly, the substrate S wound around the feeding-out shaft 20 is exhausted to then make it possible to attach a fresh core pipe around which the substrate S has been wound in a rolled shape, to the feeding-out shaft 20, making replacement of the substrate S wound around the feeding-out shaft 20.

The corona treatment apparatus 21 being the pre-treatment unit performs surface treatment for modifying the surface by performing corona discharge irradiation on the front surface, serving as the printing surface, of the substrate S being transported, to improve wettability of the ink when printing is performed. The treatment is performed when the substrate S is film-based. Hereinafter, the performing corona discharge irradiation will be referred to as corona treatment. Note that the feeding-out section 2 includes a transport shaft 24 configured to transport the substrate S in the corona treatment apparatus 21.

The feeding-out shaft 20, the transport shaft 24, and the tension roller 22 are configured to be movable in the width direction orthogonal to the transport direction Q (the direction perpendicular to the plane of the paper of FIG. 1). The feeding-out section 2 includes a steering mechanism 25 configured to suppress meandering of the substrate S by adjusting the positions of the feeding-out shaft 20, the transport shaft 24, and the tension roller 22 in the width direction (axial direction).

The steering mechanism 25 is configured by an edge sensor 251 and a non-illustrated width direction drive unit. The edge sensor 251, which is provided facing the edge portion in the width direction of the substrate S, downstream of the tension roller 22 in the transport direction Q, detects the position of the edges of the substrate S in the width direction. In addition, the non-illustrated width direction drive unit causes the feeding-out shaft 20, the transport shaft 24, and the tension roller 22 to move in the width direction in accordance with the detection result of the edge sensor 251. In this way, the meandering of the substrate S is suppressed.

The process section 3 is configured, while supporting the substrate S fed-out from the feeding-out section 2 with a platen drum 30, to perform printing onto the substrate S by appropriately performing processing with function units 51 and 52, and 61, 62, and 63 that are arranged along the outer circumferential surface of the platen drum 30. The process section 3 is provided with a front driving roller 31 and a rear driving roller 32 upstream and downstream of the platen drum 30, respectively. A printing is then performed onto the substrate S supported by the platen drum 30 while the substrate S is transported along the transport direction Q from the front driving roller 31 to the rear driving roller 32.

The front driving roller 31, in which a plurality of minute protrusions are formed on its outer circumferential surface by thermal spraying, winds the substrate S fed-out from the feeding-out section 2 from the back surface side of the substrate S. Then, the front driving roller 31, by being rotated clockwise in FIG. 1, transports the substrate S fed-out from the feeding-out section 2 toward downstream in the transport direction Q. Note that the front driving roller 31 is provided with a nip roller 31*n*. The nip roller 31*n* is in contact with the front surface of the substrate S while being biased toward the front driving roller 31, and nips the substrate S between the nip roller 31*n* and the front driving roller 31. This makes it possible to ensure a frictional force between the front driving roller 31 and the substrate S, to reliably perform transporting the substrate S by means of the front driving roller 31.

The platen drum 30 is a cylindrical shaped drum having, for example, a diameter of 400 mm, which is rotatably supported by a non-illustrated support mechanism in both the transport direction Q and its opposite direction. The platen drum 30 then winds the substrate S being transported from the front driving roller 31 to the rear driving roller 32 from the back surface side of the substrate S. In addition, the platen drum 30 supports the substrate S from the back surface side of the substrate S while being driven to rotate in the transport direction Q of the substrate S by receiving a frictional force between the platen drum 30 and the substrate S.

The process section 3 is provided with a driven roller 33 and a tension roller 34 (driven roller) configured to turn up/down the substrate S at both sides of the part at which the substrate S is wound around the platen drum 30. The driven roller 33 winds the front surface of the substrate S between the front driving roller 31 and the platen drum 30 to turn up the substrate S. While the tension roller 34 winds the front surface of the substrate S between the platen drum 30 and the rear driving roller 32 to turn down the substrate S. As such, turning up/down the substrate S at each of upstream and downstream of the platen drum 30 in the transport direction Q makes it possible to ensure a long length of the part at which the substrate S is wound around the platen drum 30.

The rear driving roller 32, in which a plurality of minute protrusions are formed on its outer circumferential surface by thermal spraying, winds the substrate S transported from the platen drum 30 via the tension roller 34, from the back surface side of the substrate S. Then, the rear driving roller 32, by being rotated clockwise in FIG. 1, transports the substrate S to the winding section 4.

Note that the rear driving roller 32 is provided with a nip roller 32*n*. The nip roller 32*n* is in contact with the front surface of the substrate S while being biased toward the rear driving roller 32, and nips the substrate S between the nip roller 32*n* and the rear driving roller 32. This makes it possible to ensure a frictional force between the rear driving roller 32 and the substrate S, to reliably perform transporting the substrate S by means of the rear driving roller 32.

As such, the substrate S being transported from the front driving roller 31 to the rear driving roller 32 is supported by the outer circumferential surface of the platen drum 30. The process section 3 is then provided with a plurality of printing heads 51 of line-type corresponding to mutually different colors in order to print a color image onto the front surface of the substrate S supported by the platen drum 30. Note that the printing head 51 and the printing head 52 that will be described later each constitute a printing unit.

In the embodiment, as the printing heads 51, five pieces of the printing heads 51 (51W, 51Y, 51C, 51K, and 51M) corresponding to white, yellow, cyan, black, and magenta, respectively, are arranged in this color order in the transport direction Q. The printing heads 51, which each face the front surface of the substrate S wound around the platen drum 30 with a slight clearance between the printing heads 51 and the front surface, discharge ink of corresponding color (colored ink) in an inkjet scheme. Then, the printing heads 51 each discharge ink onto the substrate S being transported in the transport direction Q to form a color image on the front surface of the substrate S.

In addition, as the ink, an ultraviolet (UV) ink (photocurable ink), which is cured by being irradiated with ultraviolet rays (light), is used. Accordingly, in order to cure and fix the ink on the substrate S, the process section 3 is provided with UV irradiation apparatuses 61, 62, and 63. Note that this ink curing is performed passing through separate two stages of temporary curing and final curing.

The UV irradiation apparatus 61 for final curing is disposed downstream of the printing head 51W for white and upstream of the printing head 51Y for yellow. The UV irradiation apparatus 61 for final curing is configured, by irradiating with ultraviolet light having a strong intensity, to perform curing (final curing) to a degree that the wet-spreading of the ink is prevented. On the other hand, the UV irradiation apparatus 62 for temporary curing is disposed downstream of the printing head 51Y for yellow, the printing head 51C for cyan, the printing head 51K for black, and the printing head 51M for magenta. The UV irradiation apparatus 62 for temporary curing is configured, by irradiating with ultraviolet light having less intensity, to cure (temporarily cure) the ink to a degree that the wet-spreading of the ink is sufficiently retarded compared to a case where the ultraviolet light is not irradiated.

As such, the UV irradiation apparatus 61 disposed downstream of the printing head 51W for white effects final curing of the ink for white, thus preventing the wet-spreading of the ink. In addition, the UV irradiation apparatus 62 disposed downstream of the printing head 51M for magenta causes the colored inks discharged from the printing heads 51Y, 51C, 51K, and 51M to be temporarily cured before the colored inks are mixed, thus suppressing an occurrence of color mixture. In this way, a color image is formed on the substrate S.

Further, the printing head 52 is provided downstream of the UV irradiation apparatus 62 in the transport direction Q. The printing head 51, which faces the front surface of the substrate S wound around the platen drum 30 with a slight clearance between the printing head 51 and the front surface, discharges a clear UV ink from nozzles onto the front surface of the substrate S in an inkjet scheme. This allows a transparent ink to be further discharged onto the color image formed by the printing heads 51 for five colors. The transparent ink is discharged onto the entire surface of the color image to provide a color image with a texture such as a glossy or a matte feeling.

Further, the UV irradiation apparatus 63 is provided downstream of the printing head 51 in the transport direction Q. The UV irradiation apparatus 63 is configured, by irradiating with ultraviolet light having a strong intensity, to finally cure the transparent ink discharged from the printing head 52 in conjunction with final curing the four colored inks that are discharged from the printing heads 51Y, 51C, 51K, and 51M to be temporarily cured. This allows the four colored inks and the transparent ink to be fixed onto the front surface of the substrate S.

As such, in the process section 3, inks are appropriately discharged and cured onto the substrate S wound around the outer periphery of the platen drum 30, to thus form a color image coated with a transparent ink. The substrate S on which the color image is formed is then transported to the winding section 4 by the rear driving roller 32.

In addition to the winding shaft 40 around which the end of the substrate S is wound, the winding section 4 includes a tension roller 41 (driven roller) configured to wind the substrate S between the winding shaft 40 and the rear driving roller 32 from the back surface side of the substrate S. The winding shaft 40 supports the substrate S by winding the end of the substrate S around the winding shaft 40 with the front surface of the substrate S facing outward. Then, when the winding shaft 40 is rotated clockwise in FIG. 1, the substrate S having been transported from the rear driving roller 32 is wound around the winding shaft 40 via the tension roller 41. Incidentally, the substrate S is wound around the winding shaft 40 via a core pipe 42 being attachable to/detachable from the winding shaft 40. Accordingly, the substrate S wound around the winding shaft 40, when reached maximum winding amount that is allowed, can be detached together with the core pipe.

Next, an electrical configuration for controlling the printer 1 will be described below.

Figure 2:
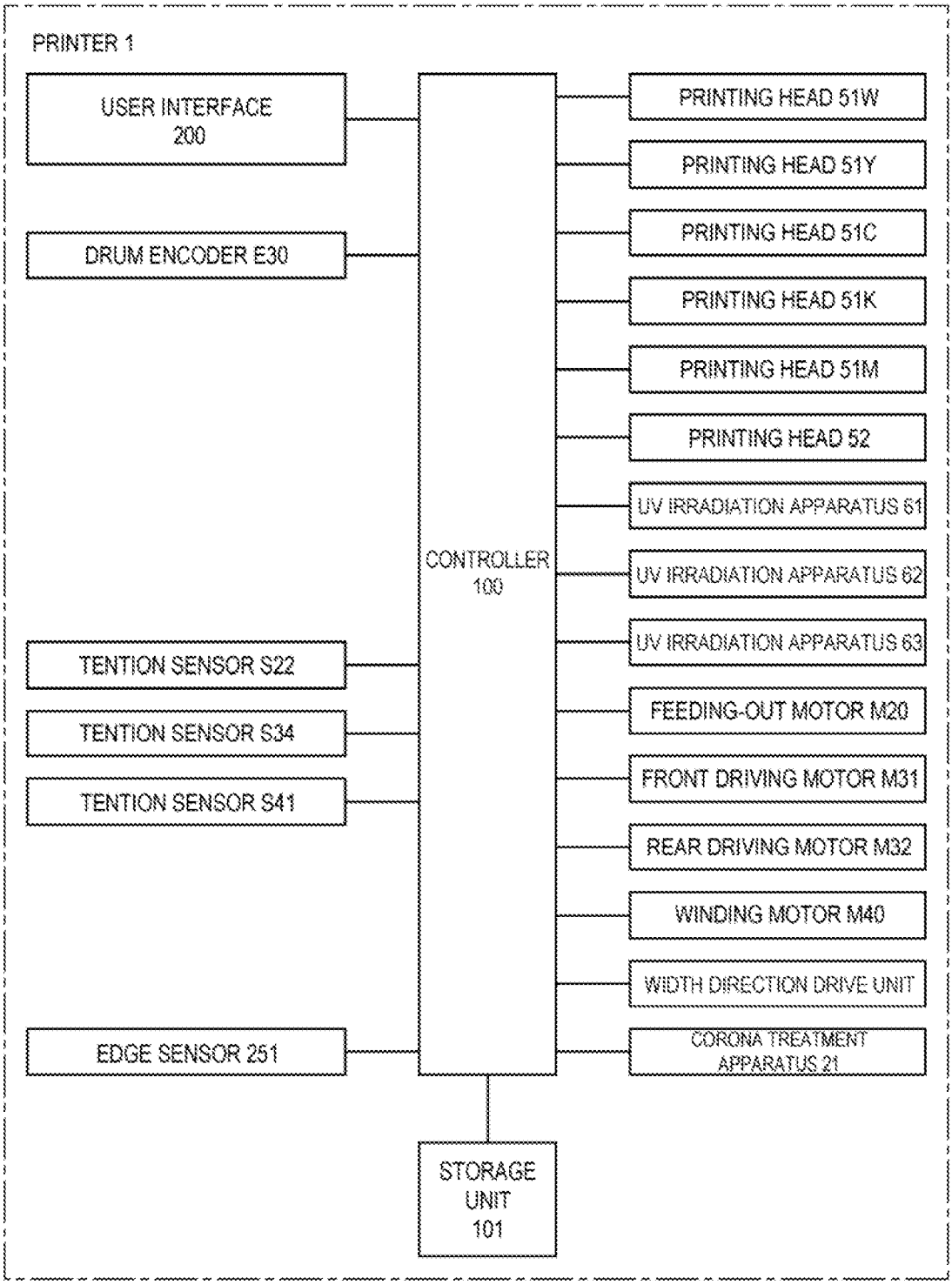
FIG. 2 is a block diagram schematically illustrating an electrical configuration for controlling a printer.

FIG. 2 is a block diagram schematically illustrating an electrical configuration for controlling the printer 1.

As illustrated in FIG. 2, the printer 1 is provided with a controller 100 configured to comprehensively control the components of the apparatus. The controller 100 is a computer configured by a Central Processing Unit (CPU) and a Random Access Memory (RAM).

The printer 1 is provided with a user interface 200 configured to function as an interface between the controller 100 and the user. The user interface 200 is configured by input devices such as a computer mouse and a keyboard, and an output device such as a display. Accordingly, the user can enter a desired command into the controller 100 by operating the input devices of the user interface 200, and can confirm the operating status of the printer 1 by ascertaining the output device of the user interface 200. Note that the input device and the output device need not be configured separately, and these may be integrally configured by a touch panel display or the like.

The controller 100 controls the printing heads 51 and 52, the UV irradiation apparatuses 61, 62, and 63, the corona treatment apparatus 21, and the components of the apparatus of a substrate transport system based on commands input from the user via the user interface 200 and commands received from other external devices.

The controller 100 controls the ink discharge timing of each of the printing heads 51 for forming the color image, in accordance with the transport of the substrate S. Specifically, the control on the ink discharge timing is performed based on the outputs (detection values) of a drum encoder E30, attached to the rotation axis of the platen drum 30, configured to detect the rotational position of the platen drum 30.

The platen drum 30, which is driven to rotate along with the transport of the substrate S, makes it possible to determine the transport position of the substrate S by referencing the output of the drum encoder E30 configured to detect the rotational position of the platen drum 30. Thus, the controller 100 generates a print timing signal (PTS) from the output of the drum encoder E30, and controls the ink discharge timing of each of the printing heads 51 based on the PTS to cause an ink discharged from each of the printing heads 51 to land at the target position on the substrate S being transported, to thus form a color image.

In addition, the timing at which the printing head 52 discharges a transparent ink is controlled by the controller 100 based on the output of the drum encoder E30 as well. This makes it possible to adequately discharge the transparent ink to the color image formed by the plurality of printing heads 51.

The controller 100 further controls the timing of turning on/off and the irradiation amount of the UV irradiation apparatuses 61, 62, and 63. The controller 100 also controls, for the corona treatment apparatus 21, the timing of turning on/off and the irradiation amount of the corona irradiation based on an input operation by the user from the user interface 200.

The controller 100 has a function to control the transport of the substrate S. The transport control on the substrate S is mainly performed as a steering control, tension control, and the like on the substrate S. The steering control is performed using the steering mechanism 25 provided at the feeding-out section 2. That is, the controller 100 causes the width direction drive unit to adjust the positions of the feeding-out shaft 20, the transport shaft 24, and the tension roller 22 in the width direction in accordance with the detection results of the edge sensor 251, thus performing feedback control on the position of the substrate S in the width direction. In addition, the tension control is performed using the feeding-out shaft 20, the front driving roller 31, the rear driving roller 32, and a motor, described below, connected to the winding shaft 40, among the members constituting the substrate transport system.

As for the tension control on the substrate S, the controller 100 causes the feeding-out motor M20 configured to drive the feeding-out shaft 20 in a direct drive scheme to rotate, to thus deliver the substrate S from the feeding-out shaft 20 to the front driving roller 31. At this time, the controller 100 controls the torque of the feeding-out motor M20 to adjust a tension (a feeding-out tension Ta) on the substrate S from the feeding-out shaft 20 to the front driving roller 31. In other words, the controller 100 controls the torque of the feeding-out motor M20 to adjust the feeding-out tension Ta in the region of the feeding-out section 2.

A tension sensor S22 configured to detect the magnitude of the feeding-out tension Ta is attached to the tension roller 22 disposed between the feeding-out shaft 20 and the front driving roller 31. The tension sensor S22 can be configured by a load cell configured to detect the magnitude of the force received from the substrate S, for example. The controller 100 then performs feedback control on the torque of the feeding-out motor M20 based on the detection results (detection values) of the tension sensor S22 to adjust the feeding-out tension Ta on the substrate S.

The controller 100 also rotates the front driving roller M31 configured to drive the front driving roller 31 and the rear driving motor M32 configured to drive the rear driving roller 32. This allows the substrate S fed-out from the feeding-out section 2 to pass through the process section 3. At this time, a speed control is performed on the front driving roller M31, while a torque control is performed on the rear driving motor M32. That is, the controller 100, based on the output of an encoder of the front driving roller M31, performs feedback control on the rotational speed of the front driving roller M31 to adjust the transport speed of the substrate S. This allows the substrate S to be transported by the front driving roller 31 at the printing speed set as the transport speed of the substrate S when printing is performed. The controller 100 also calculates the transport position (transport distance) of the substrate S based on the output of an encoder of the front driving roller M31.

On the other hand, the controller 100 controls the torque of the rear driving motor M32 to adjust the tension (a process tension Tb) on the substrate S from the front driving roller 31 to the rear driving roller 32. In other words, the controller 100 controls the torque of the rear driving motor M32 to adjust the process tension Tb in the region of the process section 3.

A tension sensor S34 configured to detect the magnitude of the process tension Tb is attached to the tension roller 34 disposed between the platen drum 30 and the rear driving roller 32. The tension sensor S34 can be configured by a load cell configured to detect the magnitude of the force received from the substrate S, for example. The controller 100 then performs feedback control on the torque of the rear driving motor M32 based on the detection results (detection values) of the tension sensor S34 to adjust the process tension Tb on the substrate S.

The controller 100 also causes a winding motor M40 configured to drive the winding shaft 40 in a direct drive scheme to rotate, to thus wind the substrate S being transported by the rear driving roller 32 around the winding shaft 40. At this time, the controller 100 controls the torque of the winding motor M40 to adjust a tension (a winding tension Tc) on the substrate S from the rear driving roller 32 to the winding shaft 40. In other words, the controller 100 controls the torque of the winding motor M40 to adjust the winding tension Tc in the region of the winding section 4.

A tension sensor S41 configured to detect the magnitude of the winding tension Tc is attached to the tension roller 41 disposed between the rear driving roller 32 and the winding shaft 40. The tension sensor S41 can be configured by a load cell configured to detect the magnitude of the force received from the substrate S, for example, The controller 100 then performs feedback control on the torque of the winding motor M40 based on the detection results (detection values) of the tension sensor S41 to adjust the winding tension Tc on the substrate S.

Specifically, the controller 100 adjusts the tensions Ta, Tb, and Tc to print tensions Ta1, Tb1, and Tc1, respectively, during the transport period in which the substrate S is transported along with an execution of the printing operation. The controller 100 also adjusts the tensions Ta, Tb, and Tc to standby tensions Ta2, Tb2, and Tc2, respectively, during a standby period in which the transport of the substrate S is stopped without executing the printing operation.

Here, it is noted that the standby tensions Ta2, Tb2, and Tc2 is a tension that is less than the print tensions Ta1, Tb1, and Tc1, respectively, (Ta2<Ta1, Tb2<Tb1, and Tc2<Tc1). In addition, the print tensions Ta1, Tb1, and Tc1 can also be referred to as transport tension that is necessary for properly transporting the substrate S.

As described above, in the embodiment, the feedback control on the rotational speed of the front driving roller M31 is performed to adjust the transport speed of the substrate S being transported by the front driving roller 31. Note that in the embodiment, there are four types of printing speeds, and any one of the printing speeds can be set by the controller 100, including an input command by the user. In the embodiment, the printing speeds can be set to four types of 7.6 m/min, 15 m/min, 30 m/min, and 50 m/min, for example. Note that the printing speed can also be referred to as transport speed of the substrate S when printing is performed.

In addition, there are two types of acceleration rates, in the embodiment, as the acceleration rate for starting the transport from a state where transport is stopped, to reach the printing speed (set transport speed). Note that the acceleration rate are set by an input of attribute information of the substrate S. The attribute information of the substrate S includes the width, thickness, constituent materials, and the like of the substrate S. The controller 100 sets the acceleration rate of any one of the two types based on an input command by the user of the attribute information of the substrate S. In the embodiment, the acceleration rate can be set to two types of 110.5 mm/sec$^2$ as acceleration rate when transporting with normal tension, and 44.2 mm/sec$^2$ as acceleration rate when transporting with low tension, for example.

Note that the printer 1 includes a storage unit 101 configured to store various types of information. The storage unit 101 stores a program describing control procedures for performing the various types of controls described above. Accordingly, the controller 100 reads a necessary program from the storage unit 101, and performs the various types of controls described above.

Further, the storage unit 101 stores a table for setting the amount (distance) by which the substrate S is transported until the discharge of the ink from the start of transport from a state where the transport of the substrate S is stopped. Note that the amount by which the substrate S is transported until printing is performed from the start of transport of the substrate S will be hereinafter referred to as pre-discharge transport distance. In the embodiment, the controller 100 reads the table and controls the printing unit to start transporting the substrate S and to start printing after the transport distance of the substrate S reached the pre-discharge transport distance.

Note that the table is a table in which printing conditions that will be described below are associated with a pre-discharge transport distance according to the printing conditions. In the embodiment, the printing conditions include with/without corona treatment, an acceleration rate until the speed becomes constant with respect to the printing speed, and set transport speed.

Hereinafter, how to set the pre-discharge transport distance will be described.

First, a description will be given about a failure when a printing is started without properly ensuring the pre-discharge transport distance.

Specifically, when the front driving roller 31 and the nip roller 31*n* are stopped nipping the substrate S between the rollers, constituents derived from the material of the nip roller 31*n* that bled out from the nip roller 31*n* adhere to the region of the substrate S having been nipped between the front driving roller 31 and the nip roller 31*n*, and then when the transport of the substrate S is started and printing is performed onto the region to which the constituents adhere, a failure occurs in which the quality of the printed image is deteriorated. Hereinafter, the deterioration of the image quality occurred in the region of the substrate S having been nipped between the front driving roller 31 and the nip roller 31*n* will be referred to as nip mark.

Further, when printing is performed before the transport speed becomes constant at the printing speed after the start of transport of the substrate S, a failure occurs in which the quality of the printed image is deteriorated.

Further, when printing is performed before the tensions (the print tensions Ta1, Tb1, and Tc1) become stable after the start of transport of the substrate S, a failure occurs in which the quality of the printed image is deteriorated.

In addition, when printing is performed in the region where the pre-treatment by the pre-treatment unit, which is, in the embodiment, the corona treatment by the corona treatment apparatus 21 is not stable, the quality of the printed image is deteriorated. Note that the region where the corona treatment is not stable refers to a region where the corona treatment has been performed on the substrate S before the transport speed becomes constant at the printing speed.

Accordingly, the conditions required for eliminating the above-described failure and for properly setting the pre-discharge transport distance are described below. In other words, it is necessary to ensure the transport distance stated in the following conditions.

Note that the conditions vary depending on whether a pre-treatment (corona treatment) is performed (with/without pre-treatment) on the substrate S using the pre-treatment unit (the corona treatment apparatus 21) installed upstream of the front driving roller 31 in the transport direction Q. Although the corona treatment apparatus 21 is provided in the embodiment, a case where printing onto the substrate S is performed by the printing unit without performing corona treatment on the substrate S is defined as a first mode. Further, a case where printing onto the substrate S is performed by the printing unit after corona treatment is performed on the substrate S using the corona treatment apparatus 21 is defined as a second mode.

The conditions in the first mode for performing printing without performing corona treatment are provided below.

As the condition 1, there is defined the transport distance until the region of the substrate S having been nipped between the front driving roller 31 and the nip roller 31*n* passes through the printing head disposed most downstream in the transport path R of the substrate S (the printing head 52 in the embodiment).

As the condition 2, there is defined the distance over which the substrate S is transported until the transport speed becomes constant from the start of transport of the substrate S.

As the condition 3, there is defined the distance over which the substrate S is transported until the tension of the substrate S being transported becomes stable.

Further, in the first mode, in order to properly set the pre-discharge transport distance, it is necessary to calculate the distance in the condition in which the distance is the longest distance among the conditions 1, 2, and 3 described above. Then, provided that the longest distance is the first longest distance, the pre-discharge transport distance needs to be set to a value not less than the first longest distance. Note that a step in which the controller 100 sets the pre-discharge transport distance to a value not less than the first longest distance is referred to as first pre-discharge transport distance setting step in the embodiment.

The conditions in the second mode for performing printing after performing corona treatment are provided below.

As the condition 1, there is defined the transport distance until the region of the substrate S having been nipped between the front driving roller 31 and the nip roller 31*n* passes through the printing head disposed most downstream in the transport path of the substrate S (the printing head 52 in the embodiment).

As the condition 3, there is defined the distance over which the substrate S is transported until the tension of the substrate S being transported becomes stable.

As the condition 4, there is defined the distance over which the substrate S is transported until the transport speed becomes constant from the start of transport of the substrate S (as in the condition 2 in the first mode), plus the transport distance until the leading end portion of the region of the substrate S that is corona-treated with the corona treatment apparatus 21 passes through the printing head 52 disposed most downstream in the transport path R of the substrate S after the transport speed became constant (after the termination of the acceleration).

Further, in the second mode, in order to properly set the pre-discharge transport distance, it is necessary to calculate the distance in the condition in which the distance is the longest distance among the conditions 1, 3, and 4 described above. Then, provided that the longest distance is the second longest distance, the pre-discharge transport distance needs to be set to a value not less than the second longest distance. Note that a step in which the controller 100 sets the pre-discharge transport distance to a value not less than the second longest distance is referred to as second pre-discharge transport distance setting step in the embodiment.

Next, how to determinate the pre-discharge transport distance in the first mode (when corona treatment is not performed) will be described below.

Figure 3:
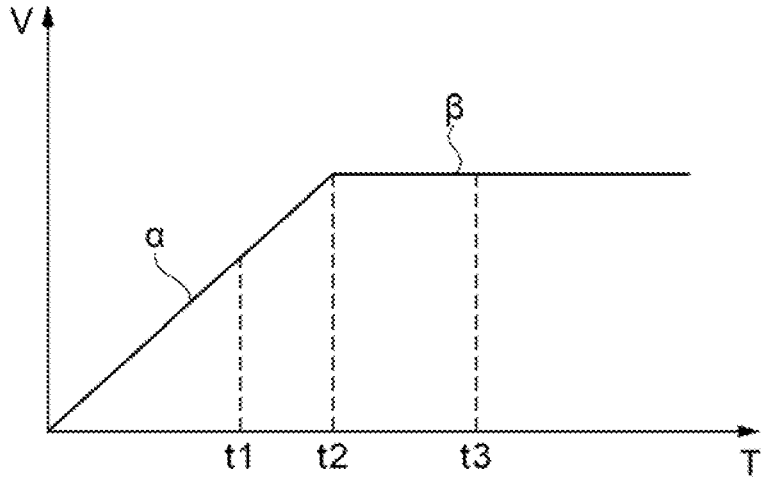
FIG. 3 is a graph schematically illustrating a relationship to time (distance) until conditions when corona treatment is not performed are achieved.

FIG. 3 illustrates an example of a case where corona treatment is not performed, and is a graph schematically illustrating a relationship to time (distance) until the conditions are achieved.

In FIG. 3, the horizontal axis denotes the time axis (T), and the vertical axis denotes the velocity axis (V). Further, FIG. 3 illustrates change in speed until and after the substrate S has become constant at the printing speed from a state in which the substrate S is stopped, after the start of transport of the substrate S. As illustrated in FIG. 3, the inclined line portion $\alpha$ indicates an acceleration region until reaching the set transport speed, where the acceleration region indicates an intermediate state in which the velocity is accelerated at the set acceleration rate, and the flat linear portion β indicates that the set transport speed has been reached.

In FIG. 3, the time t1 indicates, while the acceleration is performed, a time at which the region of the substrate S having been nipped between the front driving roller 31 and the nip roller 31*n* passes through the printing head 52 disposed most downstream in the transport path R of the substrate S. The time t2 indicates a time at which the acceleration is terminated because the set transport speed was reached, in other words, because the transport speed became constant. The time t3 indicates a time at which the tensions (the print tensions Ta1, Tb1, and Tc1) become stable. Note that the transport distance is calculated by the above-described time and the change in velocity. Here, the time t1 corresponds to the condition 1, the time t2 corresponds to the condition 2, and the time t3 corresponds to the condition 3.

In case of the first mode, in the example of FIG. 3, the time (distance) until the tension of the substrate S being transported in the condition 3 corresponding to the time t3 becomes stable is the longest, thus this distance is the first longest distance. Further, in order to prevent occurrence of failure, a value (feed amount) that is not less than the first longest distance is needed as the pre-discharge transport distance.

Note that FIG. 3 illustrates an example in the first mode, and in the embodiment, the condition on which the distance is the first longest distance differs depending on combination of the two types of acceleration rates and the four types of printing speeds.

Next, how to determinate the pre-discharge transport distance in the second mode (when corona treatment is performed) will be described below.

Figure 4:
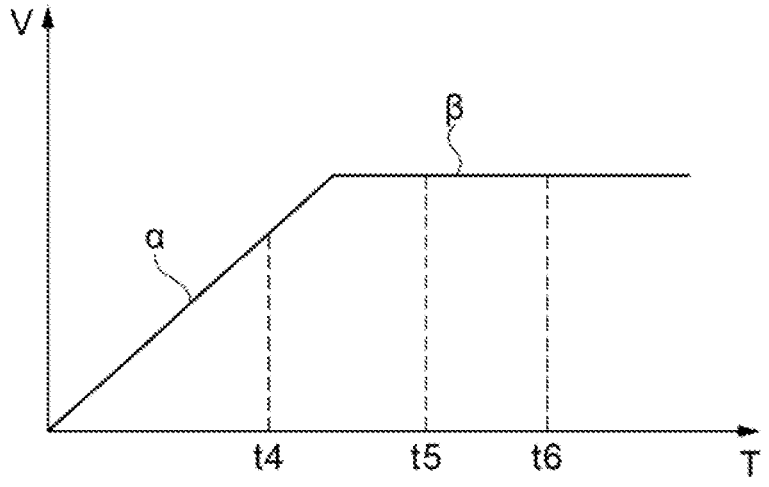
FIG. 4 is a graph schematically illustrating a relationship between a time (distance) until conditions when corona treatment is performed are achieved.

FIG. 4 illustrates an example of a case where corona treatment is performed, and is a graph schematically illustrating the relationship to time (distance) until the conditions are achieved.

In FIG. 4, as in FIG. 3, the horizontal axis denotes the time axis (T), and the vertical axis denotes the velocity axis (V). Further, FIG. 4 illustrates change in speed until and after the substrate S has become constant at the printing speed from a state in which the substrate S is stopped, after the start of transport of the substrate S. In FIG. 4, as in FIG. 3, the inclined line portion α indicates an acceleration region until reaching the set transport speed, where the acceleration region indicates an intermediate state in which the velocity is accelerated at the set acceleration rate, and the flat linear portion β indicates that the set transport speed has been reached.

In FIG. 4, the time t4 indicates, while the acceleration is performed, a time at which the region of the substrate S having been nipped between the front driving roller 31 and the nip roller 31*n* passes through the printing head 52 disposed most downstream in the transport path R of the substrate S. The time t5 indicates a time at which the tensions (the print tensions Ta1, Tb1, and Tc1) become stable. The time t6 indicates the distance until the transport speed becomes constant from the start of the transport (the distance until the termination of acceleration), and the time until the leading end portion of the region of the substrate S that is corona-treated with the corona treatment apparatus 21 passes through the printing head 52 disposed most downstream in the transport path R of the substrate S after the transport speed became constant (after the termination of the acceleration). Note that the transport distance is calculated by the above-described time and the change in velocity. Here, the time t4 corresponds to the condition 1, the time t5 corresponds to the condition 3, and time t6 corresponds to the condition 4.

In case of the second mode, in the example of FIG. 4, the time (distance) in the condition 4 corresponding to the time t6 is the longest, thus this distance is the second longest distance. Further, in order to prevent occurrence of failure, a value (feed amount) that is not less than the second longest distance is needed as the pre-discharge transport distance. Note that FIG. 4 illustrates an example in the second mode, and in the embodiment, the condition on which the distance is the second longest distance differs depending on combination of the two types of acceleration rates and the four types of printing speeds.

Next, the inventors describe experiment results obtained when the printing conditions are combined in the first mode and the second mode.

FIG. 5 is a diagram illustrating the results of the transport distance for the conditions when an experiment when the printing conditions are combined is performed.

The printing conditions to be combined are three conditions of corona treatment, an acceleration rate until the transport speed becomes constant, and a printing speed. Specifically, there are two printing conditions of with/without corona treatment. In addition, in case of the without corona treatment, the first mode is set, while in case of the with corona treatment, the second mode is set. There are two types of acceleration rates, which are normal transport (110.5 mm/sec$^2$) and low-tension transport (44.2 mm/sec$^2$). There are four types of printing speeds, which are 7.6 m/min, 15 m/min, 30 m/min, and 50 m/min.

Accordingly, FIG. 5 is a diagram illustrating, in the first mode, the results of determining the transport distance for achieving the conditions 1, 2, and 3, while, in the second mode, the results of determining the transport distance for achieving the conditions 1, 3, and 4, when the above-described printing conditions are combined. In FIG. 5, the results are classified into two patterns based on with/without corona treatment. That is, the results are classified into two patterns, that is, the first mode and the second mode, based on with/without corona treatment. Next, for the modes, the results are classified into two patterns based on the acceleration rate. Next, for the acceleration rates, the results are classified into four patterns based on the printing speed. Accordingly, 16 patterns of combinations are obtained in total. The 16 patterns of combinations are referred by corresponding reference signs of A through P, and the following description will be given with a combination A through a combination P.

Here, the conditions 1 to 4 will be described below again.

The conditions in the first mode are given as the conditions 1, 2, and 3.

The condition 1 defines a transport distance until the region of the substrate S having been nipped between the front driving roller 31 and the nip roller 31*n* passes through the printing head disposed most downstream in the transport path R of the substrate S (the printing head 52 in the embodiment). The condition 2 defines a distance over which the substrate S is transported until the transport speed becomes constant from the start of the transport. The condition 3 defines a distance over which the substrate S is transported until the tension of the substrate S being transported becomes stable.

The conditions in the second mode are given as the conditions 1, 3, and 4.

The condition 1 and the condition 3 define as in the first mode. The condition 4 defines the distance over which the substrate S is transported until the transport speed becomes constant from the start of the transport (as in the condition 2 in the first mode), plus the transport distance until the leading end portion of the region that is corona-treated with the corona treatment apparatus 21 passes through the printing head 52 disposed most downstream in the transport path R of the substrate S after the transport speed became constant (after the termination of the acceleration).

In FIG. 5, the combination A through the combination H are the combinations in the first mode. In addition, the combination A through the combination P are the combinations in the second mode. For example, how to refer to the figure in the combination A will be described below.

In the combination A, there is represented a case in which corona treatment is not performed (first mode), the acceleration rate is the normal transport (110.5 mm/sec$^2$), and the printing speed is 7.6 m/min. Further, the result in case of the combination A (transport distance) is 1.85 m in the condition 1, 0.09 m in the condition 2, and 0.99 m in the condition 3.

As a result, provided that the distance in the condition in which the distance is the longest distance (transport distance) among the conditions 1, 2, and 3 is the first longest distance, it can be recognized that the first longest distance is 1.85 m in the condition 1. Accordingly, it can be recognized that the pre-discharge transport distance must be set to a value not less than 1.85 m, which is the first longest distance. This allows the pre-discharge transport distance to be 1.85 m as in the first longest distance.

However, the pre-discharge transport distance recommended by the inventors, including a measurement error and the like, is listed in the column on the right side from the condition 4, in FIG. 5. As listed in FIG. 5, in case of the combination A, the pre-discharge transport distance recommended by the inventors is set to 2.0 m. Note that this value is a value of not less than 1.85 m.

Note that in the embodiment, the pre-discharge transport distance in the first mode is set to a value not less than the first longest distance, and is set to a value in unit of 0.5 m in the range of not less than the first longest distance. In addition, the pre-discharge transport distance in the second mode, which will be described below, is also set to a value not less than the second longest distance, and is set to a value in unit of 0.5 m in the range of not less than the second longest distance. The pre-discharge transport distance is then set to a value close to the first longest distance and the second longest distance. Note that the unit of 0.5 m are used for suppressing the complexity caused when the unit is set to a value that is less than this unit, and for simplifying the way of setting.

As a result of another combination in the first mode, in the combination B, the first longest distance is 1.85 m in the condition 1, where in this case, the pre-discharge transport distance is 2.0 m. In the combination C, the first longest distance is 3.84 m in the condition 3, where in this case, the pre-discharge transport distance is 4.0 m. In the combination D, the first longest distance is 5.77 m in the condition 3, where in this case, the pre-discharge transport distance is 6.0 m.

In the combination E, the first longest distance is 1.85 m in the condition 1, where in this case, the pre-discharge transport distance is 2.0 m. In the combination F, the first longest distance is 1.85 m in the condition 1, where in this case, the pre-discharge transport distance is 2.0 m. In the combination G, the first longest distance is 3.57 m in the condition 2, where in this case, the pre-discharge transport distance is 4.0 m. In the combination H, the first longest distance is 9.87 m in the condition 2, where in this case, the pre-discharge transport distance is 10.0 m.

As a result of a combination in the second mode, in the combination I, the second longest distance is 2.9 m in the condition 4, where in this case, the pre-discharge transport distance is 3.0 m. In the combination J, the second longest distance is 3.16 m in the condition 4, where in this case, the pre-discharge transport distance is 3.5 m. In the combination K, the second longest distance is 4.23 m in the condition 4, where in this case, the pre-discharge transport distance is 4.5 m. In the combination L, the second longest distance is 6.76 m in the condition 4, where in this case, the pre-discharge transport distance is 7.0 m.

In the combination M, the second longest distance is 3.03 m in the condition 4, where in this case, the pre-discharge transport distance is 3.5 m. In the combination N, the second longest distance is 3.70 m in the condition 4, where in this case, the pre-discharge transport distance is 4.0 m. In the combination O, the second longest distance is 6.38 m in the condition 4, where in this case, the pre-discharge transport distance is 6.5 m. In the combination P, the second longest distance is 12.68 m in the condition 4, where in this case, the pre-discharge transport distance is 13.0 m. As listed in FIG. 5, the pre-discharge transport distance can be determined in correspondence with the combination of the printing conditions.

Next, a description will be given below about an operation including the controller 100 when the transport of the substrate S is started in order to perform printing from a state where the transport of the substrate S is stopped.

Note that the printer 1 stores, in the storage unit 101, the table in which the above-described printing conditions are associated with the pre-discharge transport distance corresponding to the printing conditions. The figure illustrated in FIG. 5 may be paraphrased to represent a table.

The user, before starting of the transport, operates the input device of the user interface 200 to input or select attribute information, acceleration rate, and a printing speed of the substrate S. The controller 100 reads the table, and selects a proper combination of the printing conditions for the substrate S to be printed, based on the attribute information, the acceleration rate, and the printing speed that are input. The controller 100 then sets the pre-discharge transport distance corresponding to the selected combination. In other words, the controller 100 collates the printing conditions with the table to set the pre-discharge transport distance.

Note that the step in which the controller 100 collates the printing conditions with the table to set the pre-discharge transport distance is the first pre-discharge transport distance setting step in the first mode, and is the second pre-discharge transport distance setting step in the second mode. Specifically, the first pre-discharge transport distance setting step is a step in the first mode, and the controller 100 selects combination from the combination A to the combination H listed in FIG. 5 based on the attribute information, the acceleration rate, and the printing speed, and sets the pre-discharge transport distance corresponding to the selected combination. In addition, the second pre-discharge transport distance setting step is a step in the second mode, and the controller 100 selects combination from the combination I to the combination P listed in FIG. 5 based on the attribute information, the acceleration rate, and the printing speed, and sets the pre-discharge transport distance corresponding to the selected combination.

This allows the controller 100, when receiving an input command for starting printing, to control, in the first pre-discharge transport distance setting step or in the second pre-discharge transport distance setting step, the motors (M20, M31, M32, and M40), the tension sensors (S22, S34, and S41), the corona treatment apparatus 21, and the like to start transporting the substrate S. The controller 100 then determines whether the transport distance of the substrate S reached the pre-discharge transport distance. Then, when the transport distance reached the pre-discharge transport distance, the controller 100 subsequently controls the printing heads 51 and 52 as the printing unit, the UV irradiation apparatuses 61, 62, and 63, and the like to start printing.

As described above, according to the printer 1 and the printing method of the printer 1 of the embodiment, the following advantages can be achieved.

According to the printer 1 of the embodiment, the controller 100 sets the pre-discharge transport distance to a value not less than the first longest distance, provided that the distance in the condition in which the distance is the longest distance among the conditions 1, 2, and 3 is a first longest distance. The controller 100 then controls the printing unit to start transporting the substrate S from a state where the transport of the substrate S is stopped, and to start printing after the transport distance of the substrate S reached the pre-discharge transport distance.

This allows the pre-discharge transport distance, as in the condition 1, to be not less than the distance until the region of the substrate S having been nipped between the front driving roller 31 and the nip roller 31*n* passes through the printing head 52 disposed most downstream in the transport path R of the substrate S, and thus, even when constituents derived from the material of the nip roller 31*n* adhere to the substrate S, the printing is performed after the region where the constituents adhere to the substrate S passed through the printing head 52 disposed most downstream in the transport path R of the substrate S, thus preventing occurrence of nip mark. Further, the pre-discharge transport distance, as in the condition 2, is not less than the distance until the transport speed becomes constant from the start of the transport, thus preventing deterioration in quality of the printed image. In addition, the pre-discharge transport distance, as in the condition 3, is not less than the distance until the tensions Ta1, Tb1, and Tc1 on the substrate S being transported become stable, thus preventing deterioration in quality of the printed image. This allows the pre-discharge transport distance, which is the amount by which the substrate S is transported before ink is discharged, to be properly set when printing is performed, thus preventing deterioration in quality of the printed image.

According to the printer 1 of the embodiment, the printer 1 includes the corona treatment apparatus 21 being the pre-treatment unit upstream of the printing unit, and has the second mode for performing printing onto the substrate S by the printing unit after performing corona treatment on the substrate S. When the second mode is selected, the pre-discharge transport distance is set to a value not less than the second longest distance, provided that the distance in the condition in which the distance is the longest distance among the conditions 1, 3, and 4 is the second longest distance.

This allows the pre-discharge transport distance, as in the condition 1, to be not less than the distance until the region of the substrate S having been nipped between the front driving roller 31 and the nip roller 31*n* passes through the printing head 52 disposed most downstream in the transport path R of the substrate S, and thus, even when constituents derived from the material of the nip roller 31*n* adhere to the substrate S, the printing is performed after the region where the constituents adhere to the substrate S passed through the printing head 52 disposed most downstream in the transport path R of the substrate S, thus preventing occurrence of nip mark. Further, the pre-discharge transport distance, as in the condition 3, is not less than the distance until the tensions Ta1, Tb1, and Tc1 on the substrate S being transported become stable, thus preventing deterioration in quality of the printed image. In addition, the pre-discharge transport distance, as in the condition 4, is not less than the distance until the transport speed becomes constant from the start of the transport, plus the distance until the leading end portion of the region of the substrate S that is corona-treated with the corona treatment apparatus 21 passes through the printing head 52 disposed most downstream in the transport path R of the substrate S after the transport speed became constant (after the termination of the acceleration), thus preventing deterioration in quality of the printed image. This allows, even when performing corona treatment using the corona treatment apparatus 21, the pre-discharge transport distance, which is the amount by which the substrate S is transported before ink is discharged, to be properly set when printing is performed, thus preventing deterioration in quality of the printed image. Note that when the first mode for performing corona treatment on the substrate S is selected, the pre-discharge transport distance, as described above, is sufficient to be a value not less than the first longest distance, thus preventing deterioration in quality of the printed image.

The printer 1 of the embodiment includes the table in which with/without corona treatment of the corona treatment apparatus 21, an acceleration rate until the speed becomes constant, printing speed, as the printing conditions when performing printing, are associated with the pre-discharge transport distance according to the printing conditions. Then, the controller 100, when performing printing, collates the printing conditions with the table to set the pre-discharge transport distance.

This allows the controller 100, by the user inputting the attribute information of the substrate S, to collate the printing conditions with the table based on the attribute information, to set the optimum pre-discharge transport distance. This prevents deterioration in quality of the printed image, and improves usability of the printer 1.

According to the printer 1 of the embodiment, in the first mode, the pre-discharge transport distance is set to a value not less than the first longest distance, provided that the distance in the condition in which the distance is the longest distance among the conditions 1, 2, and 3 is the first longest distance. Then, the pre-discharge transport distance is set to a value, as a value not less than the first longest distance, in unit of 0.5 m in the range of not less than the first longest distance. Note that the pre-discharge transport distance is set to a value close to the first longest distance by being set in unit of 0.5 m. In addition, in the second mode, the pre-discharge transport distance is set to a value not less than the second longest distance, provided that the distance in the condition in which the distance is the longest distance among the conditions 1, 3, and 4 is the second longest distance. Then, the pre-discharge transport distance is set to a value, as a value not less than the second longest distance, in unit of 0.5 m in the range of not less than the second longest distance. Note that the pre-discharge transport distance is set to a value close to the second longest distance by being set in unit of 0.5 m. Setting the pre-discharge transport distance as such allows the loss paper to be made as short as possible.

According to the printing method of the printer 1 according to the embodiment, the printing method includes a first pre-discharge transport distance setting step in which the pre-discharge transport distance is set to a value not less than the first longest distance, provided that the distance in the condition in which the distance is the longest distance among the conditions 1, 2, and 3 is a first longest distance. The controller 100 then controls the printing unit to start transporting the substrate S from a state where the transport of the substrate S is stopped, and to start printing after the transport distance of the substrate S reached the pre-discharge transport distance.

Thereby, the pre-discharge transport distance is set to not less than the distance according to the conditions 1, 2, and 3, thus preventing deterioration in quality of the printed image. This allows the pre-discharge transport distance, which is the amount by which the substrate S is transported before ink is discharged, to be properly set when printing is performed.

According to the printing method of the printer 1 of the embodiment, the printing method includes the corona treatment apparatus 21 being the pre-treatment unit upstream of the printing unit, and has the second mode for performing printing onto the substrate S is performed by the printing unit after corona treatment is performed on the substrate S. The printing method includes a second pre-discharge transport distance setting step in which, when the second mode is selected, the pre-discharge transport distance is set to a value not less than the second longest distance, provided that the distance in the condition in which the distance is the longest distance among the conditions 1, 3, and 4 is the second longest distance. When the second mode is selected, in the second pre-discharge transport distance setting step, the pre-discharge transport distance is set to not less than the distance according to the conditions 1, 3, and 4, thus preventing deterioration in quality of the printed image. This allows, even when performing corona treatment using the corona treatment apparatus 21, the pre-discharge transport distance, which is the amount by which the substrate S is transported before ink is discharged, to be properly set when printing is performed. Note that when the first mode in which corona treatment is not performed on the substrate S is selected, the pre-discharge transport distance setting step is provided as described above, in which the pre-discharge transport distance is set to not less than the first longest distance, thus preventing deterioration in quality of the printed image.

The printing method of the printer 1 according to the embodiment includes the table in which with/without corona treatment of the corona treatment apparatus 21, an acceleration rate until the speed becomes constant, printing speed, as the printing conditions when printing is performed, are associated with the pre-discharge transport distance according to the printing conditions. Then, the controller 100, when performing printing, includes the first pre-discharge transport distance setting step and the second pre-discharge transport distance setting step, in which the printing conditions are collated with the table, to set the pre-discharge transport distance. This allows the controller 100, by the user inputting the attribute information, the acceleration rate, and the printing speed (transport speed) of the substrate S, to collate the printing conditions with the table based on the attribute information, to set the optimum pre-discharge transport distance. This prevents deterioration in quality of the printed image, and improves usability of the printer 1.

Note that, the present disclosure is not limited to the embodiments described above, and various modifications and improvements can be added to the above-described embodiments. Modifications are described below.

Modification 1

In the printer 1 according to the embodiment, the pre-discharge transport distance, in the first mode, is set to a value in unit of 0.5 m in the range of not less than the first longest distance. Further, the pre-discharge transport distance, in the second mode, is set to a value in unit of 0.5 m in the range of not less than the second longest distance. However, the value can be arbitrarily determined, and may be a value that is set in the range of at least not less than the first longest distance and not less than the second longest distance.

Further, the condition 1 defines the transport distance until the region of the substrate S having been nipped between the front driving roller 31 and the nip roller 31*n* passes through the printing head disposed most downstream in the transport path R of the substrate S (the printing head 52 in the embodiment). However, in place of the printing head disposed most downstream, the condition 1 may define the transport distance until the leading end portion passing through the printing head 51 disposed most upstream in the transport path R among the printing heads 51 configured to discharge ink of color used in an image to be printed. For example, when white ink is used for the image to be printed, the printing head disposed most upstream is the printing head 51W, where in this case, the condition 1 defines the transport distance until the region of the substrate S having been nipped between the front driving roller 31 and the nip roller 31*n* passes through the printing head 51W. Further, the condition 4 defines the distance over which the substrate S is transported until the transport speed becomes constant from the start of the transport (as in the condition 2 in the first mode), plus the transport distance until the leading end portion of the region of the substrate S that is corona-treated with the corona treatment apparatus 21 passes through the printing head 52 disposed most downstream in the transport path R of the substrate S after the transport speed became constant (after the termination of the acceleration). However, in place of the printing head 52 disposed most downstream, the condition 4 may define the transport distance until the leading end portion passing through the printing head 51 disposed most upstream in the transport path R among the printing heads 51 configured to discharge ink of color used in an image to be printed. For example, when white ink is used for the image to be printed, the printing head disposed most upstream is the printing head 51W, where in this case, the condition 4 defines the distance over which the substrate S is transported until the transport speed becomes constant from the start of the transport (as in the condition 2 in the first mode), plus the transport distance until the leading end portion of the region of the substrate S that is corona-treated with the corona treatment apparatus 21 passes through the printing head 51W after the transport speed became constant (after the termination of the acceleration).

In addition, the printer 1 of the embodiment has exemplified an inkjet printer of a line type, and may be an inkjet printer of a serial type without being limited to the inkjet printer of a line type.

Contents derived from the above-mentioned embodiment are described below.

The printing apparatus is a printing apparatus that is configured to transport a substrate in a roll-to-roll scheme, the printing apparatus including a controller, a printing unit including a printing head, and a front driving roller and a nip roller disposed upstream of the printing unit and configured to nip and transport the substrate, in which the controller is configured to control the printing unit such that a transport of the substrate is started from a state where the transport of the substrate is stopped and printing is started after a transport distance of the substrate reaches a pre-discharge transport distance, in which the pre-discharge transport distance is set to a value not less than a first longest distance, provided that a transport distance in a condition in which the transport distance is a longest distance among conditions 1, 2, and 3 provided below is the first longest distance.

Condition 1: a transport distance until a region of the substrate having been nipped between the front driving roller and the nip roller passes through the printing head disposed most downstream in a transport path of the substrate.

Condition 2: a transport distance until a transport speed of the substrate becomes constant.

Condition 3: a transport distance until tension of the substrate being transported becomes stable.

According to the above configuration, the pre-discharge transport distance, as in the condition 1, is not less than the transport distance until the region of the substrate having been nipped between a front driving roller and a nip roller passes through a printing head disposed most downstream in the transport path of the substrate S. Thus, for example, even when constituents derived from the material of the nip roller adhere to the substrate, the printing is performed after the region where the constituents adhere to the substrate passed through the printing head disposed most downstream in the transport path of the substrate, thus preventing occurrence of nip mark. Further, the pre-discharge transport distance, as in the condition 2, is not less than the transport distance until the transport speed becomes constant from the start of the transport, thus preventing deterioration in quality of the printed image. In addition, the pre-discharge transport distance, as in the condition 3, is not less than the transport distance until the tension of the substrate being transported becomes stable, thus preventing deterioration in quality of the printed image. This allows the pre-discharge transport distance, which is the amount by which the substrate S is transported before ink is discharged, to be properly set when printing is performed, thus preventing deterioration in quality of the printed image.

The printing apparatus described above may include a pre-treatment unit, disposed upstream of the printing unit in a transport path of the substrate, configured to perform pre-treatment on the substrate, the printing method having a first mode for performing printing on the substrate by the printing unit without performing the pre-treatment on the substrate by the pre-treatment unit, and a second mode for performing printing on the substrate by the printing unit after performing the pre-treatment on the substrate using the pre-treatment unit, in which when the first mode is selected, the pre-discharge transport distance may be set to a value not less than the first longest distance, while when the second mode is selected, the pre-discharge transport distance may be set to a value not less than a second longest distance, provided that a transport distance in a condition in which the transport distance is a longest distance among the conditions 1 and 3 provided above and the condition 4 provided below is the second longest distance.

Condition 4: a transport distance until the transport speed becomes constant from a start of transport of the substrate, plus a transport distance until a leading end portion of a region pre-treated with the pre-treatment unit passes through the printing head disposed most downstream after the transport speed became constant.

According to the above configuration, when the second mode is selected, the pre-discharge transport distance, as in the condition 1, is not less than the distance until the region of the substrate having been nipped between the front driving roller and the nip roller passes through the printing head disposed most downstream in the transport path of the substrate. Thus, for example, even when constituents derived from the material of the nip roller adhere to the substrate, the printing is performed after the region where the constituents adhere to the substrate passed through the printing head disposed most downstream in the transport path of the substrate, thus preventing occurrence of nip mark. Further, the pre-discharge transport distance, as in the condition 3, is not less than the transport distance until the tension of the substrate being transported becomes stable, thus preventing deterioration in quality of the printed image. In addition, the pre-discharge transport distance, as in the condition 4, is not less than the distance until the transport speed becomes constant from the start of the transport, plus the distance until the leading end portion of the region of the substrate pre-treated with the pre-treatment unit passes through the printing head disposed most downstream in the transport path of the substrate after the transport speed became constant, thus preventing deterioration in quality of the printed image. This allows, even when performing pre-treatment using the pre-treatment unit, the pre-discharge transport distance, which is the amount by which the substrate is transported before ink is discharged, to be properly set when printing is performed, thus preventing deterioration in quality of the printed image. Note that when the first mode in which the substrate is not pre-treated is selected, the pre-discharge transport distance, as described above, is sufficient to be a value not less than the first longest distance, thus preventing deterioration in quality of the printed image.

The printing apparatus described above may involve a table in which whether the pre-treatment is performed, an acceleration rate until a transport speed of the substrate becomes constant, and a printing speed set as the transport speed of the substrate, as printing conditions when printing is performed, are associated with the pre-discharge transport distance according to the printing conditions, in which the controller is configured, when performing printing, to collate the printing conditions with the table to set the pre-discharge transport distance.

According to the above configuration, the controller, by the user inputting the attribute information of the substrate, collates the printing conditions with the table based on the attribute information, to set the optimum pre-discharge transport distance. This prevents deterioration in quality of the printed image, and improves usability of the printing apparatus.

The printing method is a printing method of a printing apparatus, the printing apparatus including a controller, a printing unit including a printing head, and a front driving roller and a nip roller disposed upstream of the printing unit and configured to nip and transport the substrate, and the printing apparatus being configured to transport the substrate in a roll-to-roll scheme, in which the controller controls the printing unit such that a transport of the substrate is started from a state where the transport of the substrate is stopped and printing is started after a transport distance of the substrate reaches a pre-discharge transport distance, and in which the printing method includes setting a first pre-discharge transport distance in which the pre-discharge transport distance is set to a value not less than a first longest distance, provided that a transport distance in a condition in which the transport distance is a longest distance among conditions 1, 2, and 3 provided below is the first longest distance.

Condition 1: a transport distance until a region of the substrate having been nipped between the front driving roller and the nip roller passes through the printing head disposed most downstream in a transport path of the substrate.

Condition 2: a transport distance until a transport speed of the substrate becomes constant.

Condition 3: a transport distance until tension of the substrate being transported becomes stable.

According to the above configuration, when setting the first pre-discharge transport distance, the pre-discharge transport distance is set to not less than the transport distance according to the conditions 1, 2, and 3, thus preventing deterioration in quality of the printed image. This allows the pre-discharge transport distance, which is the amount by which the substrate S is transported before ink is discharged, to be properly set when printing is performed.

The printing method described above may involve a pre-treatment unit, disposed upstream of the printing unit in a transport path of the substrate, configured to perform pre-treatment on the substrate, the printing method including a first mode for performing printing on the substrate by the printing unit without performing the pre-treatment on the substrate by the pre-treatment unit, and a second mode for performing printing on the substrate by the printing unit after performing the pre-treatment on the substrate using the pre-treatment unit, in which the printing method may involve setting a first pre-discharge transport distance in which, when the first mode is selected, the controller sets the pre-discharge transport distance to a value not less than the first longest distance, and setting a second pre-discharge transport distance in which, when the second mode is selected, the controller sets the pre-discharge transport distance to a value not less than a second longest distance, provided that a transport distance in a condition in which the transport distance is a longest distance among the conditions 1 and 3 provided above and the condition 4 provided below is the second longest distance.

Condition 4: a transport distance until the transport speed becomes constant from a start of transport of the substrate, plus a transport distance until a leading end portion of a region pre-treated with the pre-treatment unit passes through the printing head disposed most downstream after the transport speed became constant.

According to the above configuration, when the second mode is selected, when setting the second pre-discharge transport distance, the pre-discharge transport distance is set to not less than the distance according to the conditions 1, 3, and 4, thus preventing deterioration in quality of the printed image. This allows, even when performing pre-treatment using the pre-treatment unit, the pre-discharge transport distance, which is the amount by which the substrate is transported before ink is discharged, to be properly set when printing is performed. Note that when the first mode in which pre-treatment is not performed on the substrate is selected, setting the pre-discharge transport distance is provided as described above, in which the pre-discharge transport distance is set to not less than the first longest distance, thus preventing deterioration in quality of the printed image.

The printing method described above may involve a table in which whether the pre-treatment is performed, an acceleration rate until a transport speed of the substrate becomes constant, and a printing speed set as the transport speed of the substrate, as printing conditions when printing is performed, are associated with the pre-discharge transport distance according to the printing conditions, in which the printing method, when printing is performed, may involve setting a first pre-discharge transport distance and setting a second pre-discharge transport distance, in which the printing conditions are collated with the table, to set the pre-discharge transport distance.

According to the above configuration, the controller, by the user inputting the attribute information of the substrate, collates the printing conditions with the table, when setting the pre-discharge transport distance and setting the second pre-discharge transport distance, based on the attribute information, to set the optimum pre-discharge transport distance. This prevents deterioration in quality of the printed image, and improves usability of the printing apparatus.

What is claimed is:

1. A printing apparatus configured to transport a substrate in a roll-to-roll scheme, the printing apparatus comprising:

a controller;

a printing unit including a printing head; and a front driving roller and a nip roller disposed upstream of the printing unit and configured to nip and transport the substrate, wherein the controller is configured to control the printing unit such that a transport of the substrate is started from a state where the transport of the substrate is stopped and printing is started after a transport distance of the substrate reaches a pre-discharge transport distance, wherein the pre-discharge transport distance is set to a value not less than a first longest distance, provided that a transport distance in a condition, in which the transport distance is a longest distance, among Conditions 1, 2, and 3 provided below is the first longest distance wherein Condition 1 is a transport distance until a region of the substrate that was nipped between the front driving roller and the nip roller passes through the printing head disposed most downstream in a transport path of the substrate, Condition 2 is a transport distance until a transport speed of the substrate becomes constant, and Condition 3 is a transport distance until tension of the substrate being transported becomes stable.

2. The printing apparatus according to claim 1, comprising a pre-treatment unit disposed upstream of the printing unit in a transport path of the substrate and configured to perform pre-treatment on the substrate, the printing apparatus having a first mode for performing printing on the substrate by the printing unit without performing the pre-treatment on the substrate by the pre-treatment unit, and a second mode for performing printing on the substrate by the printing unit after performing the pre-treatment on the substrate using the pre-treatment unit, wherein when the first mode is selected, the pre-discharge transport distance is set to a value not less than the first longest distance, and when the second mode is selected, the pre-discharge transport distance is set to a value not less than a second longest distance, provided that a transport distance in a condition, in which the transport distance is a longest distance, among the Conditions 1 and 3 and Condition 4 provided below is the second longest distance, wherein Condition 4 is a transport distance until the transport speed becomes constant from a start of transport of the substrate, plus a transport distance until a leading end portion of a region pre-treated with the pre-treatment unit passes through the printing head disposed most downstream after the transport speed becomes constant.

3. The printing apparatus according to claim 2, comprising a table in which whether the pre-treatment is performed, an acceleration rate until a transport speed of the substrate becomes constant, and a printing speed set as the transport speed of the substrate, as printing conditions when printing is performed, are associated with the pre-discharge transport distance according to the printing conditions, wherein the controller is configured, when performing printing, to collate the printing conditions with the table to set the pre-discharge transport distance.

4. A printing method of a printing apparatus, the printing apparatus including:

a controller;

a printing unit including a printing head; and a front driving roller and a nip roller disposed upstream of the printing unit and configured to nip and transport the substrate, and the printing apparatus being configured to transport the substrate in a roll-to-roll scheme, wherein the controller controls the printing unit such that a transport of the substrate is started from a state where the transport of the substrate is stopped and printing is started after a transport distance of the substrate reaches a pre-discharge transport distance, and wherein the printing method comprises a first pre-discharge transport distance setting step for setting the pre-discharge transport distance to a value not less than a first longest distance, provided that a transport distance in a condition, in which the transport distance is a longest distance, among Conditions 1, 2, and 3 provided below is the first longest distance, wherein Condition 1 is a transport distance until a region of the substrate that was nipped between the front driving roller and the nip roller passes through the printing head disposed most downstream in a transport path of the substrate, Condition 2 is a transport distance until a transport speed of the substrate becomes constant, and Condition 3 is a transport distance until tension of the substrate being transported becomes stable.

5. The printing method according to claim 4, comprising a pre-treatment unit disposed upstream of the printing unit in a transport path of the substrate and configured to perform pre-treatment on the substrate, the printing method including a first mode for performing printing on the substrate by the printing unit without performing the pre-treatment on the substrate by the pre-treatment unit, and a second mode for performing printing on the substrate by the printing unit after performing the pre-treatment on the substrate using the pre-treatment unit, wherein the printing method comprises a first pre-discharge transport distance setting step for setting, by the controller, the pre-discharge transport distance to a value not less than the first longest distance when the first mode is selected, and a second pre-discharge transport distance setting step for setting, by the controller, the pre-discharge transport distance to a value not less than a second longest distance when the second mode is selected, provided that a transport distance in a condition, in which the transport distance is a longest distance, among the Conditions 1 and 3 and Condition 4 provided below is the second longest distance, wherein Condition 4 is a transport distance until the transport speed becomes constant from a start of transport of the substrate, plus a transport distance until a leading end portion of a region pre-treated with the pre-treatment unit passes through the printing head disposed most downstream after the transport speed becomes constant.

6. The printing method according to claim 5, comprising a table in which whether the pre-treatment is performed, an acceleration rate until a transport speed of the substrate becomes constant, and a printing speed set as the transport speed of the substrate, as printing conditions when printing is performed, are associated with the pre-discharge transport distance according to the printing conditions, wherein the printing method comprises a first pre-discharge transport distance setting step and a second pre-discharge transport distance setting step for collating the printing conditions with the table to set the pre-discharge transport distance when printing is performed.

* * * * *